US006338887B1

(12) United States Patent
Derud

(10) Patent No.: US 6,338,887 B1
(45) Date of Patent: Jan. 15, 2002

(54) REINFORCING WEB, COVERING COMPLEX CONTAINING SAME AND USE IN VEHICLE SEAT

(75) Inventor: Pierre Derud, Loyes (FR)

(73) Assignee: Hexcel Fabrics (Societe Anonyme), Villeurbanne (FR)

( * ) Notice: Subject to any disclaimer, the term of this patent is extended or adjusted under 35 U.S.C. 154(b) by 0 days.

(21) Appl. No.: 09/424,846

(22) PCT Filed: Jun. 6, 1997

(86) PCT No.: PCT/FR98/01156

§ 371 Date: Feb. 16, 2000

§ 102(e) Date: Feb. 16, 2000

(87) PCT Pub. No.: WO98/55678

PCT Pub. Date: Dec. 10, 1998

(30) Foreign Application Priority Data

Jun. 6, 1997 (FR) ..... 97 07260

(51) Int. Cl.[7] ..... B32B 7/06

(52) U.S. Cl. ..... 428/40.1; 428/102; 428/906; 442/305; 442/316; 442/366; 442/377

(58) Field of Search ..... 428/40.1, 102, 428/906; 442/366, 377, 305, 316

(56) References Cited

U.S. PATENT DOCUMENTS

| | | | |
|---|---|---|---|
| 5,545,470 | A | 8/1996 | Schuster et al. |
| 5,632,053 | A | 5/1997 | Weingartner et al. |

FOREIGN PATENT DOCUMENTS

| | | |
|---|---|---|
| DE | 19522070 | 12/1996 |
| EP | 0190064 | 8/1986 |
| FR | 2522027 | 8/1983 |
| FR | 2664801 | 1/1992 |

*Primary Examiner*—Alexander S. Thomas
(74) *Attorney, Agent, or Firm*—Dennison, Scheiner & Schultz

(57) ABSTRACT

A reinforcing web constituted by substantially parallel and spaced-apart warp threads and by pairs of reinforcing threads, each shaped in the form of successive half-loops alternating in a weft direction. The successive half-loops of the reinforcing threads in each pair extend in opposite directions, and the pairs of threads are spaced apart from one another in such manner that the half-loops of the threads corresponding to two successive pairs overlap and together define closed loops which are set by means of flexible binding stitches formed in the overlap zones between the two half-loops and the warp threads. At least some of the reinforcing threads are constituted by metal tows. The reinforcing web is suitable for application to the seats of public transport vehicles.

17 Claims, 3 Drawing Sheets

FIG.9
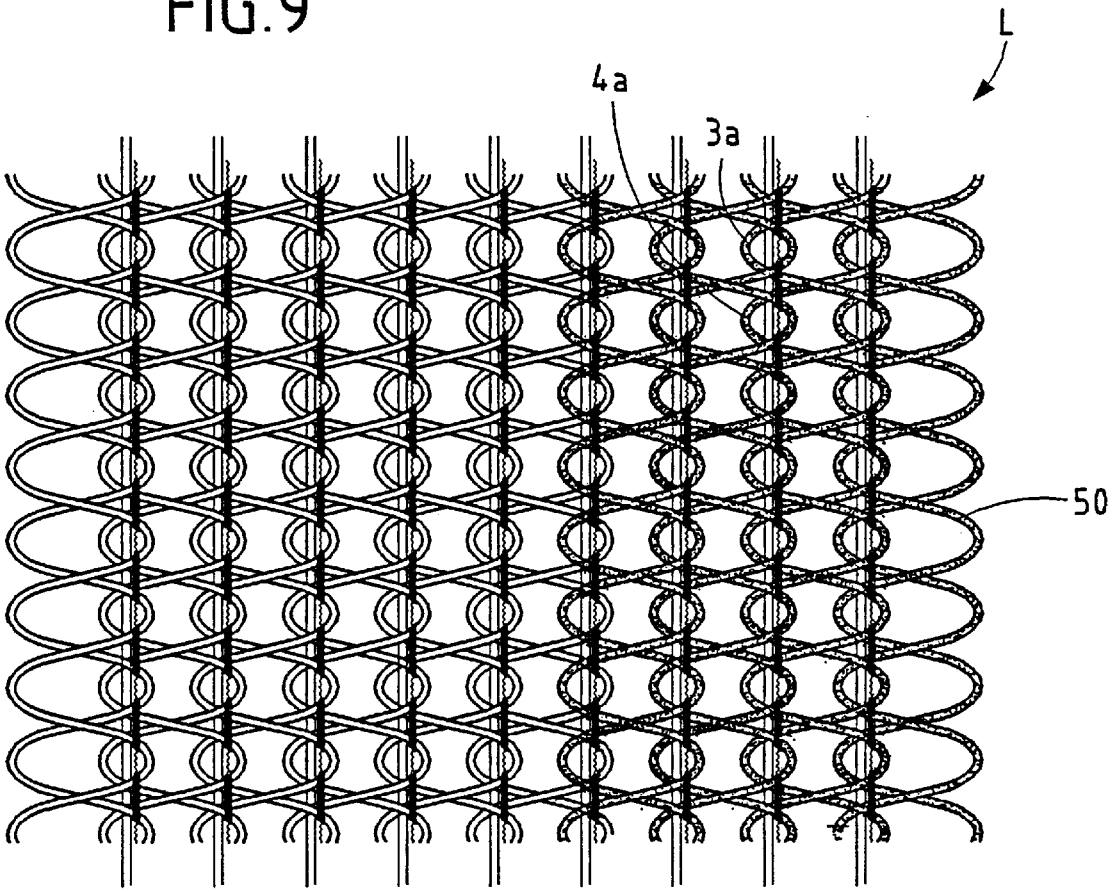
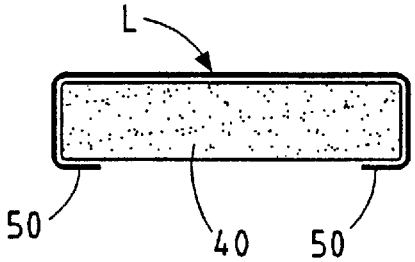
FIG.10

REINFORCING WEB, COVERING COMPLEX CONTAINING SAME AND USE IN VEHICLE SEAT

BACKGROUND OF THE INVENTION

Technical Field

The present invention relates to the technical field of reinforcement that can be applied to goods, objects, or articles which, because of their intended use, need to present a degree of resistance to wear, to damage, or indeed to deterioration due to contact with sharp or blunt instruments.

Possible applications include articles of baggage, certain panels or displays for general use, garments for sports, for gardening, for protection at work, footwear, certain inflatable pieces of equipment, and finally any goods or articles that require protection against or whose integrity needs to be maintained against the action of sharp, blunt, or abrasive objects, acting along trajectories that are rectilinear or curvilinear.

Amongst the applications mentioned, particular mention should be given to protecting the seats fitted to public transport vehicles against vandalization and laceration.

Among the requirements that need to be satisfied to reinforce goods, articles, or objects in the above applications, mention should be made of the need to be flexible in all three directions so as to make draping possible, i.e. so as to enable the reinforcement to take on the shape presented by any particular item, object, or article to be protected.

Naturally, it is also necessary to comply with the requirements of low weight per unit area so that the presence of such reinforcement does not excessively increase the weight of the article, goods, or object fitted therewith, more particularly when applied to garments, footwear, and to inflatable equipments.

In the prior art there are various proposals that have been made in an attempt to satisfy the reinforcement objective.

Mention can be made of application FR 90-09 325 which proposes putting into place a continuous web or sheet made up of helical metal springs whose turns are tangled together.

Such a proposal is unsuitable for providing a positive response to the requirements mentioned above because of the weight per unit area to which such a sheet gives rise and because of the thickness that necessarily arises when helical springs are tangled together.

Mention should also be made of U.S. Pat. No. 5,545,470 which recommends a network of metal threads and of synthetic threads disposed in an alternating and zigzag manner, while being bound together.

Although that proposal makes it possible to improve the weight per unit area of such a covering, it does not appear to be suitable for providing a positive response to the requirement for strength, given that it leaves strips of relatively low strength between the various threads, regardless of the way in which they are combined, which strips of weakness can easily be penetrated by blunt or sharp instruments.

On the basis of the knowledge that it has of the prior art, the Applicant believes that the prior art does not provide a solution capable of satisfying the multiple requirements that stem from various applications, only some of which are mentioned by way of example above.

Given this shortcoming and to the ever more pressing need to have available reinforcement that is flexible, lightweight, and strong in a wide variety of applications, the Applicant has designed a specific reinforcing web that has the particular feature of being capable of constituting a product suitable for being sold as such in the raw state, and suitable for being used in any appropriate manner by all kinds of processing industry as a function of the application in question.

The Applicant company has thus devised the subject matter of the invention so as to enable it to constitute a covering composite capable on its own of constituting a finished product suitable, not for being incorporated as such as a reinforcing web, but for use in application on a surface, as a covering, while simultaneously providing the element that it covers with the desired strength characteristics.

The Applicant has thus devised the subject matter of the invention so as to be capable of satisfying in particularly positive manner to a preferred application which it that of reinforcing the seats of public transport vehicles, which seats are well known as being subjected to frequent acts of vandalism and laceration representing a cost of renovation and refurbishment that is particularly high.

SUMMARY OF THE INVENTION

To achieve the above objects, the reinforcing web of the invention is characterized in that it is constituted by substantially parallel and spaced-apart warp threads and by pairs of reinforcing threads each shaped in the form of successive half-loops alternating in a weft direction, the successive half-loops of the reinforcing threads in each pair extending in opposite directions, and the pairs of threads being spaced apart from one another in such a manner that the half-loops of the threads corresponding to two successive pairs overlap and together define closed loops which are set by means of flexible binding stitches formed in the overlap zones between the two half-loops and the warp threads, at least some of the reinforcing threads being constituted by metal tows.

The invention also provides a strong covering composite comprising a facing layer and a reinforcing web of the above type bonded to one of the two faces of said facing layer.

Finally, by way of preferred application, the subject matter of the invention also relates to a public transport vehicle seat comprising padding or the like covered on its surface by a composite of the above type, such a composite being fitted on said padding or the like via its face which is associated with the reinforcing web.

Various other characteristics appear from the following description given with reference to the accompanying drawings which show embodiments of the invention as non-limiting examples.

BRIEF DESCRIPTION OF THE DRAWINGS

FIG. 9 is a plan view analogous to FIG. 1 but showing a variant embodiment.

FIG. 10 is a diagrammatic cross-section showing one of the advantages of the subject matter of the invention using the embodiment of FIG. 9.

DESCRIPTION OF THE PREFERRED EMBODIMENTS

Best Method of Performing the Invention

Figure 1:
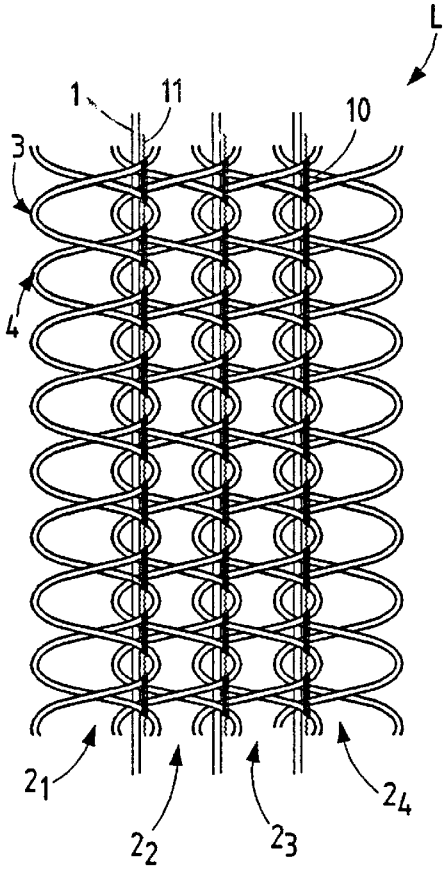
FIG. 1 is a fragmentary plan view on an enlarged scale showing the structure of the reinforcing web constituting a first embodiment of the invention.
Figure 2:
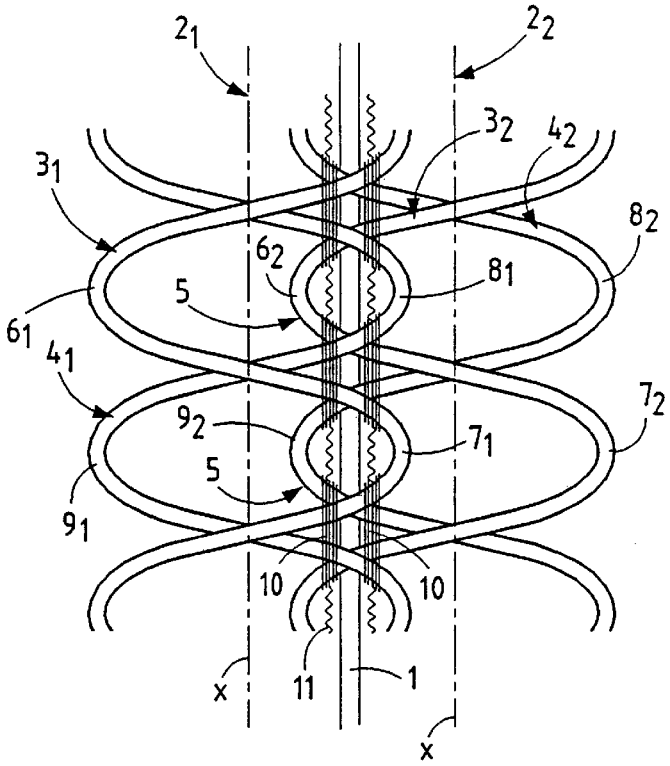
FIG. 2 is a fragmentary view on a larger scale, showing various structural details of the web of FIG. 1.

In FIGS. 1 and 2, the reinforcing web L of the invention is characterized in that it is in the form of interlaced continuous threads giving it the appearance of a fabric or knit having relatively large stitches that are free so as to be able to have a capacity for non-permanent relative deformation and flexibility in all three directions for a plane.

The reinforcing web is constituted by a plurality of warp threads 1 which are substantially parallel to one another, being spaced apart relative to one another by a spacing which can be of centimeter order, by way of indication.

The warp threads 1 are preferably constituted from filaments of glass, aramid, polyester, etc.

The threads 1 are also selected in such a manner as to be constituted merely by juxtaposed filaments that are not worked relative to one another, i.e. that are not textured, not stranded, not twisted, and not thrown.

By way of example, the warp threads 1 can be of weight lying in the range 200 decitex to 1500 decitex.

The reinforcing web also comprises pairs of "reinforcing" threads represented in this case by way of example by four pairs given references $\mathbf{2}_1$ to $\mathbf{2}_4$. Each pair 2 comprises two threads 3 and 4 which present the characteristic of being interlaced so as to form successive alternating loops in a weft direction which is considered overall as being perpendicular to the alignment of the warp threads 1. According to another characteristic, the alternate successive half-loops are formed in opposite manner for each of the two threads of each pair. According to an additional characteristic, two successive pairs of reinforcing threads such as $\mathbf{2}_1$ and $\mathbf{2}_2$ are spaced apart from each other while being oriented in parallel, in such a manner that the half-loops of the threads concerned overlap and together define closed loops such as 5, see FIG. 2.

To make the interlacing obtained in this way more comprehensible, it is appropriate to refer to FIG. 2 which shows in diagrammatic and enlarged manner the pairs of reinforcing threads 21 and 22 comprising pairs of threads $\mathbf{3}_1$ & $\mathbf{4}_1$ and $\mathbf{3}_2$ & $\mathbf{4}_2$.

The thread $\mathbf{3}_1$ forms successive half-loops $\mathbf{6}_1$ and $\mathbf{7}_1$, while the thread $\mathbf{4}_1$ forms successive half-loops $\mathbf{8}_1$ and $\mathbf{9}_1$. On this basis, it can already clearly be seen that the half-loops $\mathbf{6}_1$ & $\mathbf{8}_1$ and the half-loops $\mathbf{7}_1$ & 9extend in opposite directions, alternating for the half-loops $\mathbf{6}_1$ & $\mathbf{7}_1$ on one side and for the half-loops $\mathbf{8}_1$ & $\mathbf{9}_1$ on the other.

As explained above, the spacing condition or relative distance between the pairs of threads is such that the thread $\mathbf{3}_2$ of the pair $\mathbf{2}_2$ forms a half-loop $\mathbf{6}_2$ which overlaps the half-loop $\mathbf{8}_1$ of the thread $\mathbf{4}_1$ so that together they form the closed loop 5.

That which is true for the thread $\mathbf{3}_2$ of the pair $\mathbf{2}_2$ is likewise true for the thread $\mathbf{4}_2$ whose half-loop $\mathbf{9}_2$ forms another closed loop 5 with the corresponding half-loop $\mathbf{7}_1$ of the thread $\mathbf{3}_1$ in the pair $\mathbf{2}_1$.

In another disposition, the relative positions of the warp threads 1 and of the pairs $\mathbf{2}_1$ to $\mathbf{2}_n$ are such that the closed loops 5 in alignment parallel to the axes x of the pairs overlie the warp threads 1 in such a manner as to be capable of being bound thereto by binding stitches such as 10. Advantageously, the stitches 10 are formed by binding threads 11 which extend at least parallel to one of the sides of each thread 1, as shown in FIG. 1, or preferably on both sides of each thread 1, as shown in FIG. 2.

According to another characteristic of the invention, the reinforcing threads constituting each pair $\mathbf{2}_1$ to $\mathbf{2}_n$ are constituted by tows made of metal, and preferably of stainless steel. The term "tow" is used to designate any structure which does not have a single strand only, but which on the contrary is built up from a plurality of elementary strands so that the resulting thread element has a high degree of relative flexibility.

Each metal tow can have a structure lying between the structures conventionally referred to by the expressions 3×1 to 7×7, for example.

It is advantageous in the meaning of the invention for the metal tows that are selected to have a diameter lying in the range 0.3 mm to 1 mm.

By way of example, for a 3×3 structure, the selected tow can have a diameter of 0.65 mm, whereas for a structure of the 3×7 type, the diameter may be close to 0.63 mm.

By selecting components of the above type, it is possible to make a reinforcing web using a "crochet" type machine which offers the advantageous feature of enabling the web to be made in strips of greater or smaller width suitable for being packaged in the form of rolls, or by analogy in the form of spools, or indeed as plates in pre-cutout format.

The web structure of the kind described above makes it possible by means of the binding and the conformation in the form of alternating loops, to confer overall cohesion to the various threads set in the form of a sheet of large mesh that is easily deformable in any direction because of the relative freedom that is left available by the binding stitches 10.

This characteristic is of immense advantage since it offers inherent shaping possibilities that enable the reinforcing web to match and fit closely to all of the geometrical shapes of the goods, articles, or objects with which it is to be associated.

By adopting thread characteristics of the kind given above, the reinforcing web of the invention presents a density or weight per unit area that can lie in the range 300 $g/m^2$ to 2 $kg/m^2$.

As can be seen on the basis of the above description, and from the accompanying drawings, the reinforcing web has the characteristic of being made in the form of a meshed network in regular manner that includes closed loops 5 that are relatively close to one another in the direction parallel to the warp threads 1 and also in the weft direction from one pair of reinforcing threads to another.

Thus, the regularly meshed network provides entirely uniform resistance to forces from blunt or sharp instruments that may be applied thereto on paths that are normal or intersecting and along directions that are rectangular or curvilinear. In particular, by the succession and presence of metal tows 3, 4, such a reinforcing web provides great resistance to puncturing and cutting actions from a strong sharp blade. However, it must be understood that such a web is nevertheless suitable for being cut by a shearing action, thus enabling it to be given any required geometrical shape, useful or compatible with the shape of the goods, objects, or articles with which it is to be associated for reinforcement purposes.

In the above, it is stated that the web comprises a plurality of warp threads 1 extending parallel to one another. These threads 1 can extend as one sheet, or on the contrary as two sheets with the pairs of reinforcing threads being disposed therebetween. Under such circumstances, the binding stitches 10 then also provide binding between all of the threads concerned at the crossover and/or superposition points.

Figure 3:
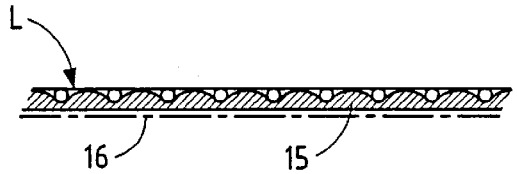
FIGS. 3 to 4 are fragmentary cross-sections showing variants of the product of the invention.

The above-described reinforcing web L can be associated with a substrate applied to one of its faces, the substrate comprising a layer of adhesive material and a peel-off protective layer. In this way, the web has mechanical "cohesion" in its own plane, thus making it easier to handle or package. In use, it suffices to remove the peel-off protection so as to be able to apply the web to an object, an item, or an article via its face that is coated in adhesive material. In this form, the web constitutes a covering composite. The web can also be associated, as shown in FIG. 3, by applying a layer 15 of flexible material on one of its faces, said material having at least one surface that is of an adhesive nature. The web L is then associated with such a layer with which it constitutes a covering composite having one face which corresponds to the web structure and another face which may be plane and smooth, or on the contrary cellular, that develops an adhesive nature on contact. The material suitable for use in constituting such a layer is not, properly speaking, part of the present invention, since the person skilled in the art should consider it as being commercially available. It can be a composition based on a polymer of the silicone, neoprene, or hot-melt type that presents a permanently adhesive nature. As shown by the chain-dotted line in FIG. 3, it can then be advantageous to cover the adhesive surface of the layer 15 in protection 16 that is suitable for being peeled off and which can easily be removed when the web is to be applied on any support that needs to be reinforced and on which such a web can be placed so as to be bonded thereto by the adhesive nature of the layer 15.

Figure 4:
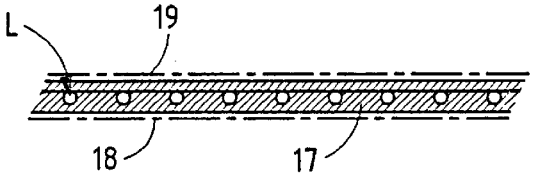

FIG. 4 shows a variant embodiment in which the web L is coated by a matrix 17 which has the same characteristics as the layer 15. In this case, the matrix 17 can then be associated with two peel-off layers of protection 18 and 19.

Figure 5:
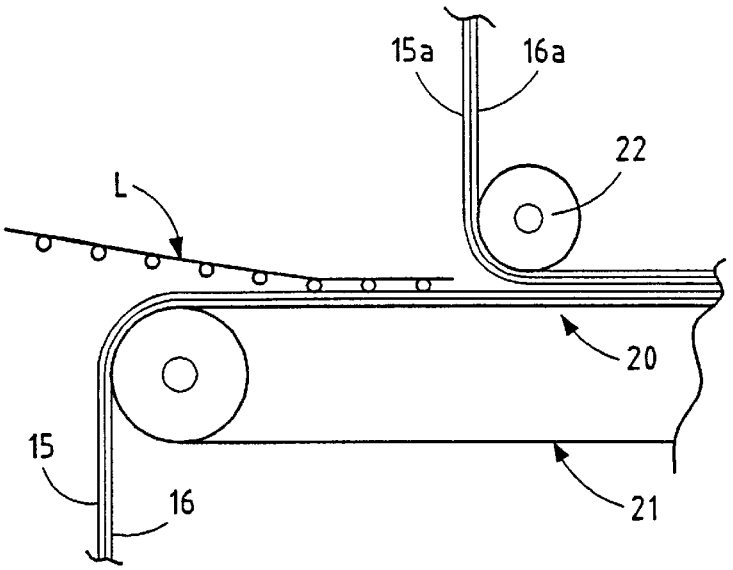
FIG. 5 is a diagram showing a stage in the operation for obtaining the product shown in FIG. 3 or FIG. 4.

FIG. 5 shows one way of making the web of FIGS. 3 and 4 by making use of a press 20 comprising, for example, an endless belt 21 and a presser cylinder 22 between which the web L passes together with the layer 15 provided with its protection 16.

By passing between the conveyor 21 and the cylinder 22, the web L and the layer 15 are intimately bonded together by the web being caused to penetrate into the layer 15 via its surface that is not provided with the protective layer 16.

A similar disposition can be implemented to form a web of the type shown in FIG. 4 by making use of a composite such as $\mathbf{15}_a$ and $\mathbf{16}_a$ delivered so as to curve round the cylinder 22 over the conveyor belt 21 so as to cover the web L which is partially embedded in the composite 15, 16.

Naturally, other methods can be used on an industrial scale for achieving the same result. Such other methods must be considered as being techniques that are equivalent and available to the person skilled in the art in the habit of performing coating and pressing operations.

Figure 6:
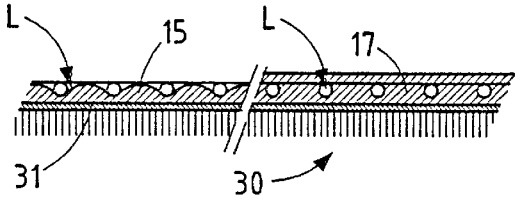
FIG. 6 is a fragmentary cross-section showing another variant.

FIG. 6 shows an additional development in which the web (L) constitutes a reinforcing structure or core for a covering composite given overall reference 30. By way of example, this composite comprises a fabric 31 of velvet or similar type, with the web L being applied to the back face thereof by means of adhesive, said web L either being in its original form or else in one of the forms shown in FIGS. 3 and 4, as can be seen on the left and right portions respectively of FIG. 6.

Such a composite advantageously constitutes a finished product enabling all or part of the surface of structures, goods, objects, or articles to be covered when it is desired to improve the strength thereof as well as ensuring a suitably attractive appearance.

Depending on the embodiment and on the way in which the covering composite is obtained, application on the surface of goods, articles, or objects can take place either directly taking advantage of the adhesive or sticky face of the web, of the layer 15 or of the matrix 17, or else by initially applying an adhesive as an interface layer, or else by applying a substance that provides controlled polymerization over time.

Such a composite 30 satisfies the above-specified characteristics of flexibility, drapeability, suitability for shaping, and suitability for cutting to size by shearing so as to present in a plane the developed shape of the object, goods, or articles to be covered.

Given the presence of the web on the inside face, any action applied to the covering or fabric 31 by means of a sharp or blunt instrument will have no consequence other than giving rise to nicks that are hardly visible, and there will be no risk of the entire composite being completely destroyed so as to give rise to gaping openings showing the underlying nature of the covered goods, objects, or articles.

Figure 7:
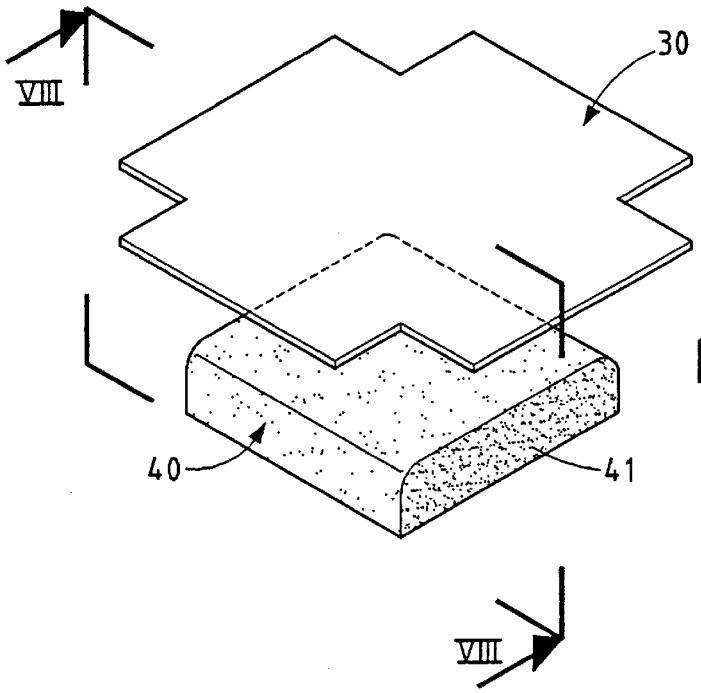
FIG. 7 is an exploded perspective view showing a preferred application step.
Figure 8:
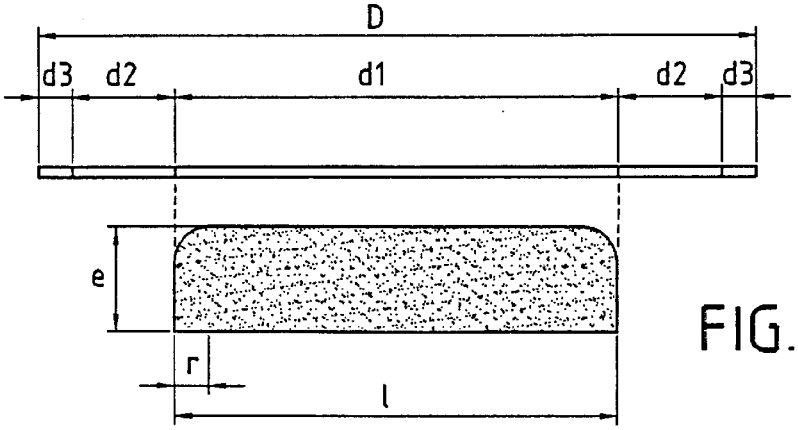
FIG. 8 is a view substantially on plane VIII—VIII of FIG. 7.

Such a characteristic is particularly advantageous in the specific application of covering vehicle seats, more specifically for use in public transport. FIG. 7 shows one such application in association with a seat cushion 40 which is the only portion shown of an entire seat structure, which seat structure is not directly concerned by the present invention.

To cover such a cushion 40, e.g. constituted completely or part by a foam filling 41, it suffices to cut out a shape of the kind shown in the drawing in the covering composite 30. This cutting can be performed by taking in one direction a total size D which corresponds to the individual measurements $d_1$ equal to the width 1 of the cushion, plus twice $d_2$ equal to the thickness e of the cushion, plus twice $d_3$ equal to the margins r.

Thus, merely adding together the measurements $d_1$, $2d_2$, plus $2d_3$ makes it possible to cut out the covering composite 30 to a size suitable for subsequently covering the cushion 40 merely by draping it and then bonding the composite thereto by the adhesive nature, specifically of the layer 15 or of the matrix 17.

Given that the covering composite 30 can easily be cut by shearing, it will be understood that the cushion 40 can be covered in a manner that is fitted, fast, and effective.

Nevertheless, it should be understood that the intrinsic flexibility of the web L makes it possible, where appropriate, to avoid cutting out corners of the kind shown in FIG. 7, and then to drape over the corners of the cushion by making folds over the corners, thereby applying an additional reinforcing effect.

From the above, it will be understood that any attempt at lacerating action applied to the fabric 31 will not damage or deteriorate the cushion 41 which is generally made in the form of a composite of synthetic material that has been foamed, because the presence of the web L constitutes a barrier.

It should be understood that the reinforcing web of the invention provides, in positive manner, improved resistance to action undertaken with a sharp or blunt instrument.

However, given its specific structure, the web of the invention also provides good resistance to the "corkscrew" test.

Some kinds of vandalism consist in inserting a corkscrew which is screwed through the external covering or decoration so as to engage one of the component elements of any stiffening or reinforcing structure in order to attempt to extract it by exerting traction.

Generally, such tests destroy and extract fibers that may be made of metal or otherwise, giving rise to sharp edges and further increasing the damage that has been voluntarily inflicted.

In the present case, if such an attempt is made, the corkscrew will not have any effect other than engaging a thread 3 or 4 which is then pulled out when traction is applied, but is not broken, given its shape in the form of successive half-loops and its lack of any rigid binding which enable it to come out without breaking.

FIG. 9 shows a variant embodiment in which at least one of the sides of the web L is made as described with reference to FIGS. 1 and 2, but using threads 3*a* and 4*a* based on synthetic material of a composition that can be identical or analogous to that of the warp threads 1. The threads 3*a* and 4*a* thus form a border or margin 50 of even more flexible nature suitable for facilitating a high degree of draping, turning under, and stapling, specifically in the context of covering a seat. Under such circumstances, the width of the web L, e.g. including two margins 50, can advantageously corresponding to the dimension D.

SUITABILITY FOR INDUSTRIAL APPLICATION

The subject matter of the invention is particularly suited to anti-vandal reinforcement of the seats in public transport vehicles.

What is claimed is:

1. A reinforcing web, comprising substantially parallel and spaced-apart warp threads and pairs of reinforcing threads, each shaped in the form of successive half-loops alternating in a weft direction, the successive half-loops of the reinforcing threads in each pair extending in opposite directions, and the pairs of threads being spaced apart from one another in such a manner that the half-loops of the threads corresponding to two successive pairs overlap and together define closed loops which are set by means of flexible binding stitches formed in overlap zones between the two half-loops and the warp threads, at least some of the reinforcing threads being constituted by metal tows.

2. A reinforcing web according to claim 1, wherein the reinforcing threads corresponding to at least one side of the web are made of a non-metal material and form a lateral strip or margin.

3. A reinforcing web according to claim 1, wherein the metal tows are constituted in part by a plurality of stranded elementary strands.

4. A reinforcing web according to claim 3, wherein the metal tows comprise those corresponding to a 3×1 structure or to a 7×7 structure, and to diameters lying in the range 0.3 mm to 1 mm.

5. A reinforcing web according to claim 1, wherein the warp threads occupy a single sheet.

6. A reinforcing web according to claim 1, wherein the warp threads occupy two parallel sheets with the reinforcing threads disposed therebetween.

7. A reinforcing web according to claim 1, wherein the binding stitches are set on either side of each warp thread.

8. A reinforcing web according to claim 1, associated, on at least one of its faces, with a surface adhesive.

9. A reinforcing web according to claim 8, wherein the adhesive face is associated on its surface with a peel-off protection.

10. A reinforcing web according to claim 1, associated, on at least one of its faces, with a layer of flexible material possessing at least one surface of adhesive nature.

11. A reinforcing web according to claim 1, embedded in a matrix coating the warp threads and the reinforcing threads, and presenting on at least one face an adhesive nature.

12. A reinforcing web according to claim 1, in the form of a rolled-up strip.

13. A reinforcing web according to claim 1, in the form of flexible formatted plates.

14. A public transport vehicle seat comprising padding covered on a surface thereof with a composite according to claim 13, said composite being fitted to said padding via the surface of the padding which is associated with the reinforcing web.

15. A strong covering composite comprising a facing layer and a reinforcing web according to claim 1 which is bonded to one of face of said facing layer.

16. A strong covering composite according to claim 15, wherein the facing layer comprises of a flexible material.

17. A strong covering composite according to claim 15, wherein the facing layer comprises a fabric.

* * * * *